US009019315B2

(12) United States Patent
Tsuda et al.

(10) Patent No.: US 9,019,315 B2
(45) Date of Patent: Apr. 28, 2015

(54) METHOD OF CONTROLLING DISPLAY

(75) Inventors: Munetaka Tsuda, Kyoto (JP); Ryoma Aoki, Kyoto (JP); Yasuto Kakimoto, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 119 days.

(21) Appl. No.: 13/606,580

(22) Filed: Sep. 7, 2012

(65) Prior Publication Data

US 2013/0321473 A1 Dec. 5, 2013

(30) Foreign Application Priority Data

May 31, 2012 (JP) ..... 2012-124965

(51) Int. Cl.
*G09G 5/00* (2006.01)
*G09G 5/14* (2006.01)
*G09G 5/34* (2006.01)

(52) U.S. Cl.
CPC ..... *G09G 5/14* (2013.01); *G09G 5/346* (2013.01); *G09G 2340/14* (2013.01); *G09G 2340/145* (2013.01)

(58) Field of Classification Search
CPC ..... G09G 2340/0414; G09G 2340/0421; G09G 2340/04; G09G 2340/045
USPC ..... 345/1.1, 204, 660, 684
See application file for complete search history.

(56) References Cited

U.S. PATENT DOCUMENTS

| | | | | |
|---|---|---|---|---|
| 5,602,566 | A * | 2/1997 | Motosyuku et al. | 345/684 |
| 8,423,915 | B2 * | 4/2013 | Aida et al. | 715/862 |
| 2006/0050090 | A1 | 3/2006 | Ahmed et al. | |
| 2006/0111634 | A1 * | 5/2006 | Wu | 600/443 |
| 2010/0058226 | A1 * | 3/2010 | Flake et al. | 715/786 |
| 2010/0199214 | A1 | 8/2010 | Mikawa | |
| 2011/0057880 | A1 * | 3/2011 | Kasahara | 345/158 |
| 2011/0225544 | A1 | 9/2011 | Demar et al. | |

FOREIGN PATENT DOCUMENTS

| | | |
|---|---|---|
| EP | 1 956 478 | 8/2008 |
| EP | 2 375 304 | 10/2011 |
| JP | 4-270384 | 9/1992 |
| JP | 2008-8917 | 1/2008 |
| WO | 99/18495 | 4/1999 |

OTHER PUBLICATIONS

Search Report for EP 12166660 dated Oct. 31, 2012, 9 pages.
Oct. 16, 2013 Search Report in EP 12198039.5, 10 pages.
U.S. Office Action (10 pgs.) dated Feb. 20, 2014 issued in co-pending U.S. Appl. No. 13/461,501 of Tsuda, et al., filed May 1, 2012.
(Continued)

*Primary Examiner* — Maurice L McDowell, Jr.
(74) *Attorney, Agent, or Firm* — Nixon & Vanderhye P.C.

(57) ABSTRACT

An exemplary information-processing device includes: a first display controller configured to display selectively on a display a first image and a second image including the first image in a reduced size; and a second display controller configured, while the second display is displayed on the display, to display an indicator image on the display, the indicator image indicating a position of an image to be displayed when display of the second image is changed to display of the first image.

16 Claims, 14 Drawing Sheets

(56) References Cited

OTHER PUBLICATIONS

U.S. Office Action issued in U.S. Appl. No. 13/461,501 dated Aug. 7, 2014.

Office Action issued in U.S. Appl. No. 13/461,501 dated Nov. 17, 2014.

Office Action issued in U.S. Appl. No. 13/461,501 dated Mar. 18, 2015.

* cited by examiner https://.....com
A B C D E
F G H I J
K L M N O
menu
Im12
141
Im11
Im13

1 2 3 4 5
6 7 8 9 1 0
A B C D E
F G H I J
K L M N O
P Q R S T
U V W X Y
Im11b
141
Im11a 6 7 8 9 1 0
A B C D E
F G H I J
K L M N O
P Q R S T
U V W X Y
Z Z Z Z Z
Im11b
141
Im11ax https://.....com
F G H I J
K L M N O
P Q R S T
menu
Im12
141
Im11x
Im13

METHOD OF CONTROLLING DISPLAY

CROSS-REFERENCE TO RELATED APPLICATIONS

This application is based on and claims priority under 35 U.S.C. 119 from Japanese Patent Application No. 2012-124965, which was filed on May 31, 2012.

FIELD

The technology relates to selectively displaying images.

BACKGROUND AND SUMMARY

When an electronic document such as a webpage is displayed, a part of the display image may be magnified.

An exemplary embodiment provides an information-processing device including: a first display controller configured to display selectively on a display a first image and a second image including the first image in a reduced size; and a second display controller configured, while the second display is displayed on the display device, to display an indicator image on the display device, the indicator image indicating a position of an image to be displayed when display of the second image is changed to display of the first image.

BRIEF DESCRIPTION OF THE DRAWINGS

Exemplary embodiments will now be described with reference to the following drawings, wherein.

DETAILED DESCRIPTION OF NON-LIMITING EXAMPLE EMBODIMENTS

Figure 1:
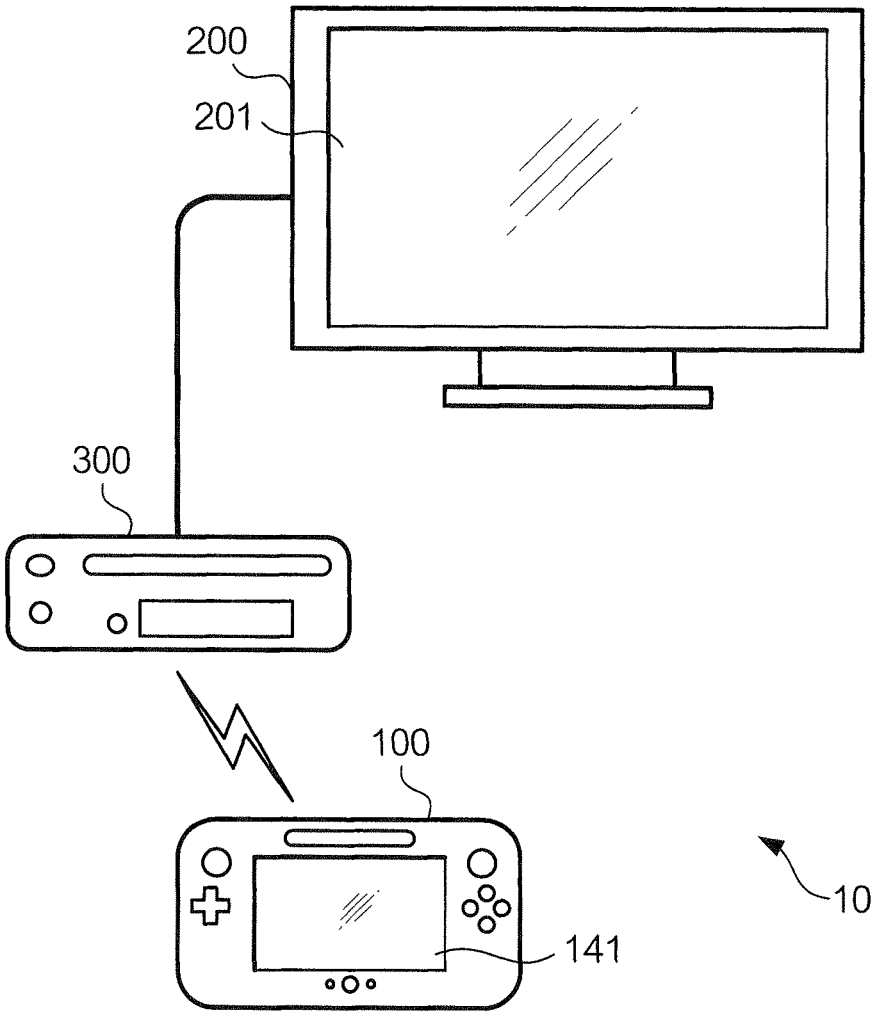
FIG. 1 shows an exemplary non-limiting diagram showing a configuration of a display system.

FIG. 1 is a diagram showing a configuration of display system 10, which is an exemplary embodiment. Display system 10 is a system for displaying a variety of images in accordance with operations performed by a user. An image displayed in display system 10 is, for example, an image of a game or a webpage, but may be another image (such as an electronic document, a still image or a moving image taken by a user, a television broadcast image, and so on). Such an image may be obtained from a content, which, when displayed on a display device of display system 10, expands beyond a display region of the display device. Therefore, a user may not be able to view such a content in its entirety at one time if the content is displayed with a normal display magnification.

Display system 10 includes controller 100, monitor 200, and main device 300. It is to be noted, however, that display system 10 may include another controller other than controller 100, or may be provided with multiple controllers 100. Further, display system 10 may be used without use of monitor 200.

Controller 100 is a terminal on which an image is displayed, and is held by a user to perform various operations. Controller 100 herein is a portable display device that has display region 141 and is to be held and operated by a user. It is to be noted that controller 100 not only presents information visually by displaying images, but also may present audible or tactile information by using sound or vibration.

Monitor 200 is a device for displaying an image, and may be, for example, a television set for receiving a television broadcast. In this explanation, monitor 200 is a stationary-type display device. It is to be noted that monitor 200 does not have to have a function of receiving a television broadcast, and may be a display device of a personal computer, or the like. It is assumed that monitor 200 has display region 201 having a larger size than display region 141 of controller 100, though display region 201 may be the same size as or smaller than display region 141 of controller 100. Further, display region 201 of monitor 200 and display region 141 of controller 100 do not have to have the same aspect ratio. Furthermore, monitor 200 is capable of presenting information not only visually but also audibly, similarly to controller 100, though monitor 200 and a speaker may be configured as separate units.

Main device 300 is an information-processing device for controlling operation of controller 100 and monitor 200. To achieve the purpose, main device 300 is connected to each of controller 100 and monitor 200 via wired or wireless communication. It is assumed here that main device 300 conducts wireless communication with controller 100 and conducts wired communication with monitor 200, though the communication may be performed in another manner.

Figure 2:
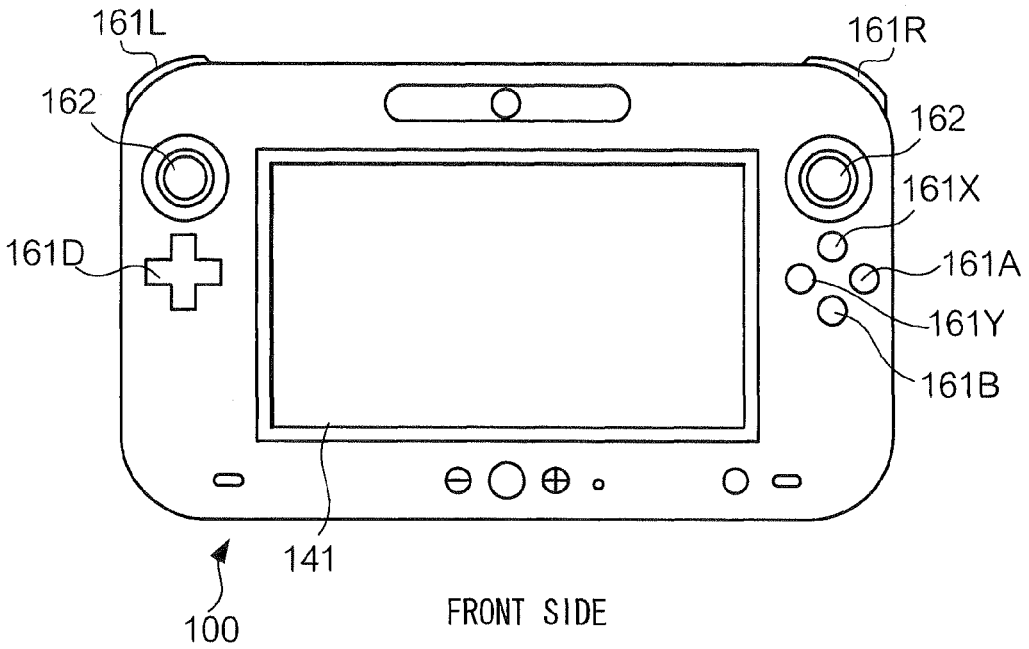
FIG. 2 shows an exemplary non-limiting diagram showing an external configuration of a controller.
Figure 2:
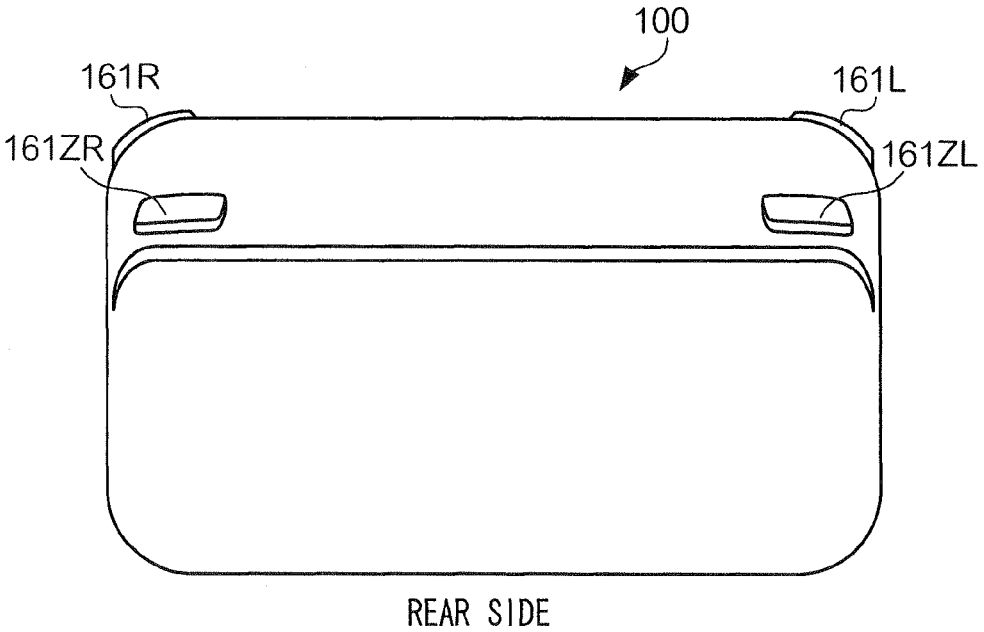

FIG. 2 is a diagram showing an external configuration of controller 100, and shows a side on which display region 141 is provided and a side opposite thereto. For convenience of explanation, the side on which display region 141 is provided will be referred to as a "front side" and the opposite side will be referred to as a "rear side" in the following description. Thus, the front side is a side facing the user when the user operates controller 100. Further, in the following description, the sides of controller 100 other than the front and rear sides will collectively be referred to as a "perimeter side."

On the front side of controller 100, there are provided A button 161A, B button 161B, X button 161X, Y button 161Y, and cross button 161D, in addition to display region 141. On the perimeter side of controller 100, there are provided L button 161L and R button 161R. Further, on the rear side of controller 100, there are provided ZL button 161ZL and ZR button 161ZR. In the following description, these buttons may simply be referred to as "buttons 161."

Buttons 161 are hardware keys that can be pressed. It is to be noted here that a hardware key is a key provided at a predetermined position of controller 100, and may also be referred to as a physical key. Buttons 161 generate operation information that indicates a state of pressing of each button (or indicates whether each button is pressed).

Further, in addition to buttons 161, slide pad 162 is provided on the front side of controller 100. Slide pad 162 generates operation information that represents a strength and a direction of a force that is imparted to slide pad 162 by a finger of the user. It is to be noted that slide pad 162 may be provided in the right-hand portion of controller 100 from the user's perspective or may be provided in each of the right-hand and left-hand portions.

Figure 3:
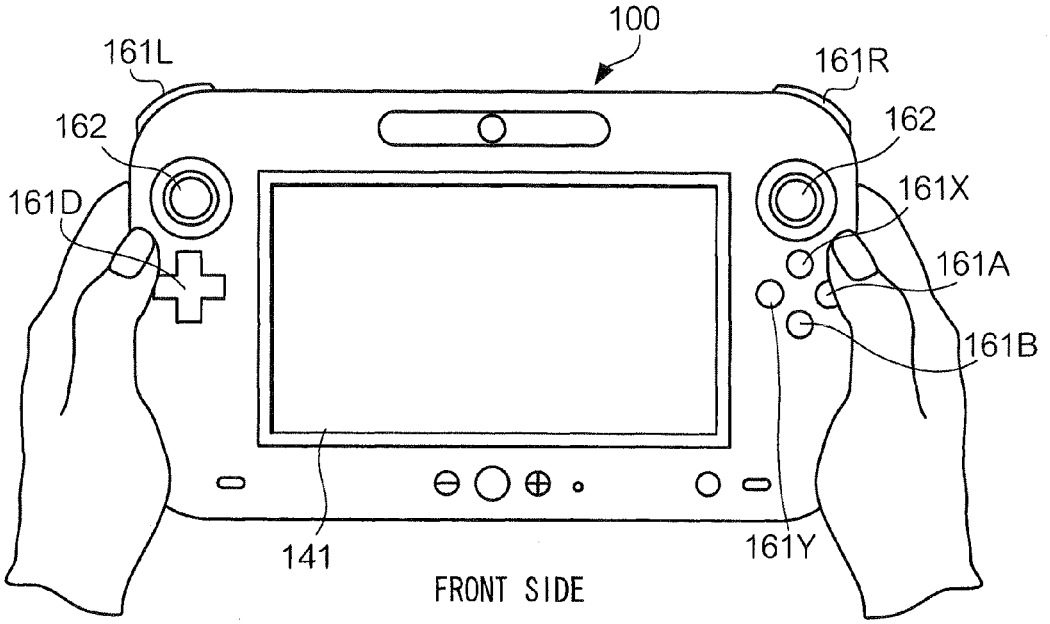
FIG. 3 shows an exemplary non-limiting diagram illustrating a state when a user holds the controller.
Figure 3:
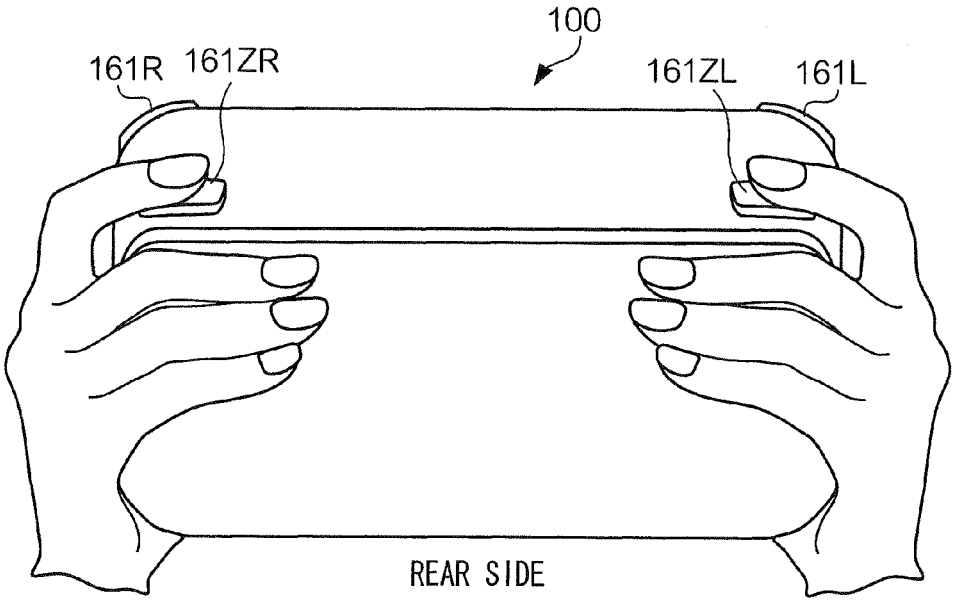

FIG. 3 is a diagram illustrating a state when a user holds controller 100 with both hands. When the user holds controller 100 as shown, the user can press ZL button 161ZL with the index finger of the left hand and press ZR button 161ZR with the index finger of the right hand. In a state where the user presses ZL button 161ZL and ZR button 161ZR using both hands, the user can hold controller 100 more steadily as compared to a case where these buttons are not pressed, and thus, if the user performs various operations on the front side of controller 100, controller 100 has a reduced tendency to move or shake. It is to be noted that the effect of holding controller 100 steadily also may be obtained by pressing L button 161L and R button 161 R simultaneously.

It is also to be noted that the way of holding controller 100 is not limited to the example shown in FIG. 3. For example, the user may place the index fingers near L button 161L and R button 161R and press ZL button 161ZL and ZR button 161ZR with the middle fingers. Further, the user may hold controller 100 so that the longer side extends in the vertical direction rather than in the horizontal direction.

Figure 4:
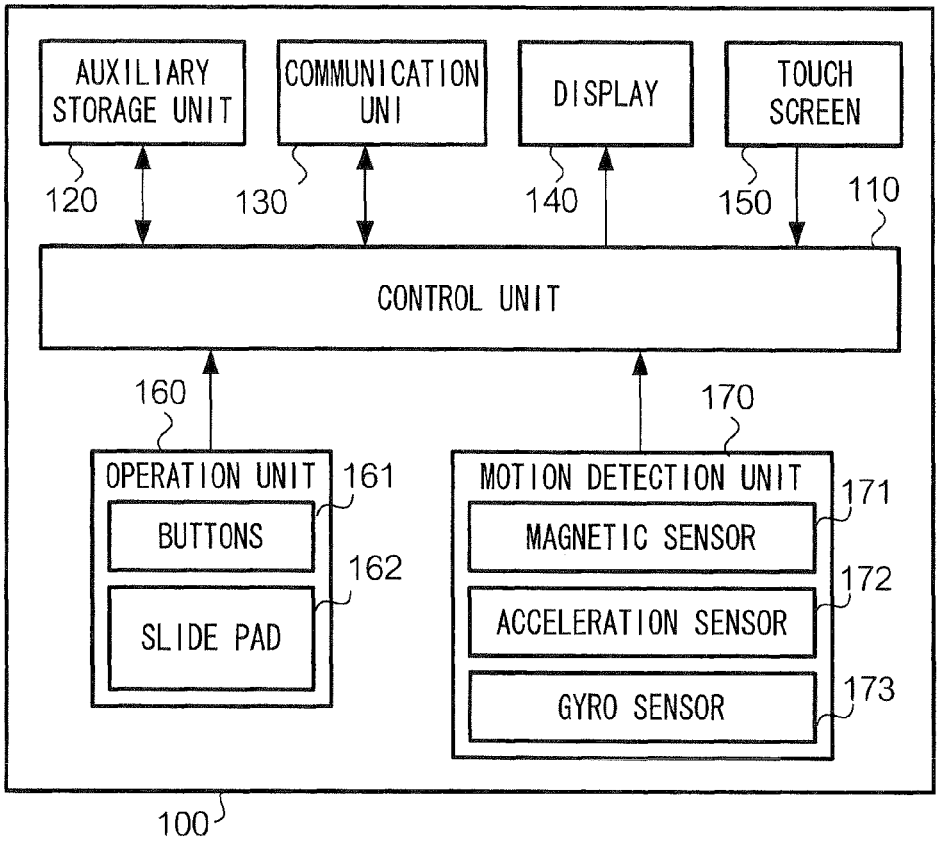
FIG. 4 shows an exemplary non-limiting block diagram showing a hardware configuration of the controller.

FIG. 4 is a block diagram showing a hardware configuration of controller 100. Controller 100 includes control unit 110, auxiliary storage unit 120, communication unit 130, display 140, touch screen 150, operation unit 160, and motion detection unit 170. Though not shown in the drawing, controller 100 may further include a camera for taking a still image or a moving image, a microphone and a speaker for input and output of sound, a vibrator for vibrating controller 100, a communication means other than communication unit 130 (e.g., an infrared communication means for communicating with another controller), and so on.

Control unit 110 is a means for controlling operations of various units of controller 100. Control unit 110 includes a processing device such as a CPU (Central Processing Unit), a memory serving as a main memory device, an input/output interface for communicating information with various units of controller 100, and so on, and executes a program(s) to control display of images or data transmission and reception to and from main device 300. Further, control unit 110 includes a codec for compressing image data to be sent to main device 300 and expanding image data received from main device 300. The format for compression and expansion performed by the codec is H.264, for example, though the format is not particularly limited.

Auxiliary storage unit 120 is a means for storing data used by control unit 110. Auxiliary storage unit 120 is a flash memory, for example. Auxiliary storage unit 120 is capable of storing data such as bookmarks, which will be described later. It is to be noted that auxiliary storage unit 120 may include a detachable storage medium such as a so-called memory card.

Communication unit 130 is a means for communicating with main device 300. Communication unit 130 includes an antenna or the like for communicating with main device 300 wirelessly.

Display 140 is a means for displaying an image. Display 140 includes a display panel having pixels formed by liquid crystal elements or organic EL (electroluminescence) elements, and a drive circuit for driving the display panel, and displays, in display region 141, an image in accordance with image data provided from control unit 110.

Touch screen 150 is a means for receiving an operation performed by a user, and generating and supplying coordinate information that represents a position in display region 141. Touch screen 150 includes a sensor disposed to overlap display region 141, and a control circuit for generating coordinate information representing a position detected by the sensor and providing the coordinate information to control unit 110. Touch screen 150 may be of resistive type, or may be of another type such as capacitive type. Further, touch screen 150 may be a so-called multi-touch screen, which can detect a user's touch at multiple positions at the same time. It is to be noted that a user may operate touch screen 150 with her/his finger, though the user may operate touch screen 150 using a pen-shaped tool such as a stylus (touch pen).

Touch screen 150 provides software keys in cooperation with display 140. A software key is a key that is provided in display region 141 by a software process. Unlike a hardware key, the position of a software key is changeable, and display/hiding of a software key can be switched.

Operation unit 160 is another means for receiving an operation performed by a user. Operation unit 160 includes the aforementioned buttons 161 and slide pad 162, and provides control unit 110 with operation information in accordance with an operation performed by a user.

Motion detection unit 170 is a means for detecting a motion of controller 100. Motion detection unit 170 includes magnetic sensor 171, acceleration sensor 172, and gyro sensor 173, whereby motion detection unit 170 generates motion information that indicates motion of controller 100 and supplies the motion information to control unit 110. Motion information represents a change in geomagnetism (namely direction) detected by magnetic sensor 171, a change in acceleration detected by acceleration sensor 172, and a change in angle or angular velocity (namely, a change in an attitude of controller 100 caused when controller 100 is moved) detected by gyro sensor 173. It is to be noted that motion detection unit 170 may be configured only to include at least one of magnetic sensor 171, acceleration sensor 172, and gyro sensor 173.

Controller 100 does not move unless an operation is performed by a user, and is caused to move as a result of shaking, tilting, or another operation performed by a user. Therefore, it can be said that motion detection unit 170 detects a motion (or operation) of a user by detecting a motion of controller 100. Thus, in this description, the motion information generated by motion detection unit 170 is included in operation information.

Figure 5:
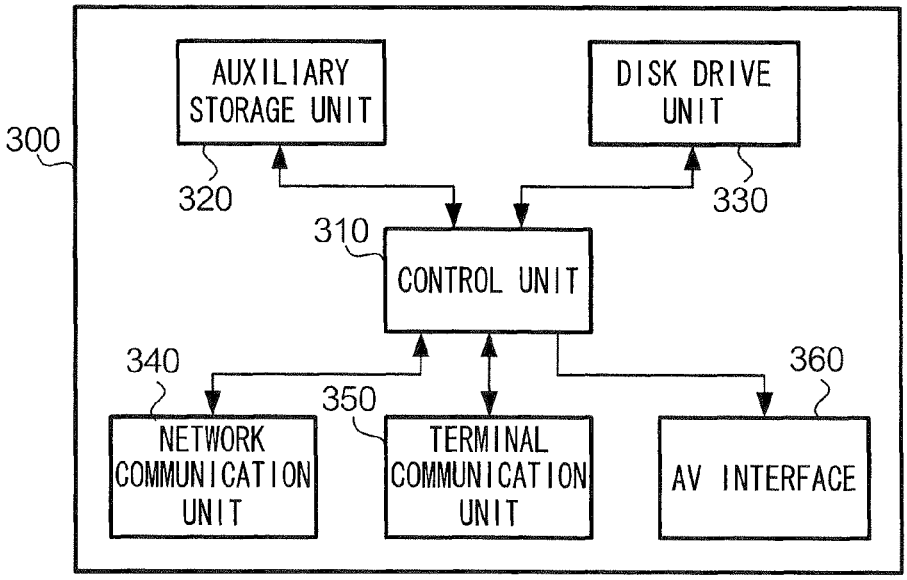
FIG. 5 shows an exemplary non-limiting block diagram showing a hardware configuration of a main device.

FIG. 5 is a block diagram showing a hardware configuration of main device 300. Main device 300 includes control unit 310, auxiliary storage unit 320, disk drive unit 330, network communication unit 340, terminal communication unit 350, and AV (Audio and Visual) interface 360.

Control unit 310 is a means for controlling operations of various units of main device 300, and corresponds to a "computer" in the exemplary embodiment. Control unit 310 includes a processing device such as a CPU, a GPU (Graphics Processing Unit), a DSP (Digital Signal Processor) or the like, a memory serving as a main memory device or a VRAM (Video Random Access Memory), an input/output interface for communicating information with various units of main device 300, and so on, and executes a program(s) to control generation of image data to be transmitted to controller 100 and monitor 200. The programs that can be executed by control unit 310 include a game program, a browser program for browsing web pages, and so on, such programs being described later. Further, control unit 310 includes a codec for compressing image data to be sent to controller 100 or monitor 200 and expanding image data received from controller 100.

Auxiliary storage unit 320 is a means for storing data used by control unit 310. Auxiliary storage unit 320 is a flash memory or a hard disk, for example, but may include a detachable storage medium such as a memory card. Auxiliary storage unit 320 is capable of storing programs to be executed by control unit 310 and data acquired via network communication unit 340 or terminal communication unit 350.

Disk drive unit 330 is a means for reading data stored in an optical disk (optical storage medium). The optical disk may store data used for playing a game, such as a game program, for example. It is to be noted that disk drive unit 330 may read data stored in another storage medium such as a magneto-optical disk or a semiconductor memory.

Network communication unit 340 is a means for communicating via a network such as the Internet. The communication performed by network communication unit 340 may be wired or wireless communication. Network communication unit 340 receives data from an external server device or transmits data thereto in accordance with instructions from control unit 310.

Terminal communication unit 350 is a means for communicating with controller 100. In a case where a controller other than controller 100 is used, terminal communication unit 350 may communicate with the other controller. The wireless communication performed by terminal communication unit 350 may utilize any communication technology such as Wi-Fi, Bluetooth, or infrared communication.

AV interface 360 is a means for supplying to monitor 200 image data, sound data, or the like. AV interface 360 includes one or more interfaces such as an HDMI (High-Definition Multimedia Interface) terminal or the like.

Figure 6:
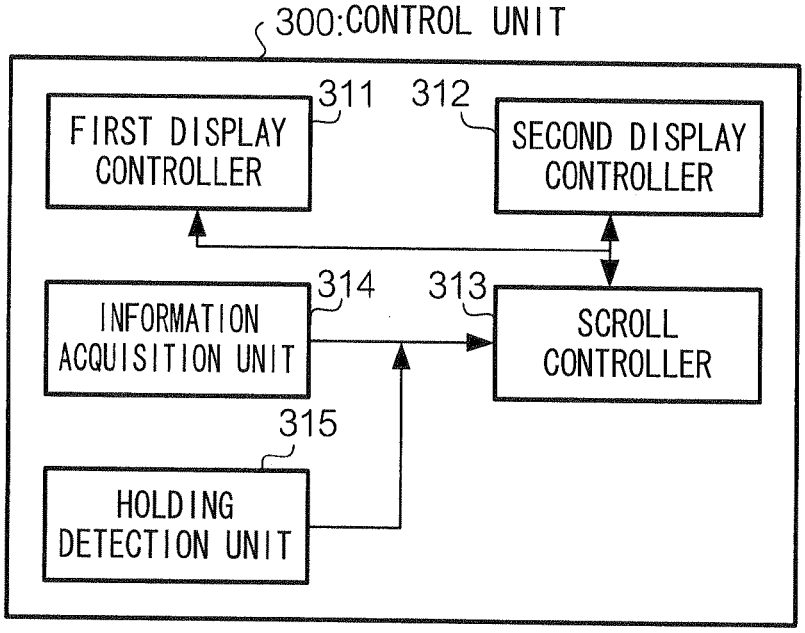
FIG. 6 shows an exemplary non-limiting block diagram showing a principal functional configuration of the main device.

FIG. 6 is a block diagram showing a principal functional configuration of main device 300. As means for enabling display of images on controller 100 and monitor 200, main device 300 includes first display controller 311, second display controller 312, scroll controller 313, information acquisition unit 314, and holding detection unit 315. The functions of these units are realized by execution of one or more programs by control unit 310 of main device 300.

First display controller 311 is a means for controlling display of an image by controller 100 and monitor 200, and is realized by control unit 310, terminal communication unit 350, and AV interface 360 of main device 300. First display controller 311 causes a display region of these display devices to display selectively a first image and a second image including the first image in a reduced size (detailed description of these images will be provided later with reference to FIG. 10). First display controller 311 causes the first image to be displayed on the display devices when a displaying operation for displaying the second image is not performed, and causes the second image to be displayed on the display devices when the displaying operation is performed.

Further, when the first image is displayed, first display controller 311 causes an operation object for performing an operation relating to the first image to be displayed, and, when the second image is displayed, first display controller 311 does not cause the operation object to be displayed. An operation object herein is an item to be operated, and an image such as an icon, a button used in a GUI (Graphical User Interface), a scroll bar, or a widget (also referred to as a control) such as a text box may be an object. Further, a character may function as a selectable object. For example, in a case where the image displayed in the display region is a webpage, a string of characters functioning as a hyperlink may be an operation object.

Second display controller 312 is a means for controlling display of an image by controller 100 and monitor 200, and is realized by control unit 310, terminal communication unit 350, and AV interface 360 of main device 300. When the second image is displayed on the display devices, second display controller 312 causes an indicator image to be displayed, the indicator image indicating a position of an image to be displayed if display of the second image is switched to display of the first image (detailed description of the indicator image will be provided later with reference to FIGS. 10 and 11).

Scroll controller 313 is a means for controlling scrolling of an image, and is realized by control unit 310, terminal communication unit 350, and AV interface 360 of main device 300. Scrolling herein indicates a mode of display in which an image that is not displayed in its entirety in the display region is caused to move in a prescribed direction such that a portion that has not been displayed becomes visible. In the present exemplary embodiment, "scrolling" not only indicates movement of an image in an up-down direction (vertical direction), but also may include movement of an image in a left-right direction (horizontal direction) or in an oblique direction. Scroll controller 313 at least controls scrolling of an image displayed on controller 100 in accordance with a scrolling operation performed by a user. However, it is possible that scroll controller 313 also controls scrolling of an image displayed on monitor 200. For example, in a case where a portion of an image (e.g., a webpage) is displayed commonly on controller 100 and on monitor 200, scroll controller 313 can cause the image displayed on monitor 200 to scroll in accordance with scrolling of the image displayed on controller 100.

Information acquisition unit 314 is a means for acquiring operation information relating to an operation performed by a user, and is realized by control unit 310 and terminal communication unit 350 of main device 300. Operation information is information transmitted from controller 100 in response to a user operation. In addition to a state of pressing of respective buttons 161, operation information may include coordinate information provided by touch screen 150 and motion information provided by motion detection unit 170.

Holding detection unit 315 is a means for detecting holding of controller 100 by a user, and is realized by control unit 310 and terminal communication unit 350 of main device 300. Holding detection unit 315 utilizes predetermined operation information to detect that the user is holding controller 100 in a prescribed manner. In this exemplary embodiment, when it is found that each of ZL button 161ZL and ZR button 161ZR is pressed, holding detection unit 315 detects that the user is holding controller 100 with both hands, as shown in FIG. 3.

Holding detection unit 315 may detect holding of controller 100 by a user based on another operation. For example, holding detection unit 315 may detect holding of controller 100 by a user based on pressing of L button 161L and R button 161L instead of based on pressing of ZL button 161ZL and ZR button 161ZR, or may detect holding of controller 100 when all of these four buttons are pressed. Further, instead of detecting pressing of a hardware key, holding detection unit 315 may detect holding of controller 100 by a user based on interaction with another sensor (e.g., touch sensor) by a user.

It is to be noted that main device 300 does not have to include every unit shown in FIG. 6. Further, main device 300 may realize the functions of the units shown in FIG. 6 by executing a single program or multiple programs.

The foregoing is a description of the configuration of display system 10. In this configuration, main device 300 causes at least one of controller 100 and monitor 200 to display an image. Depending on a user operation and/or a type of an image to be displayed, main device 300 may cause only one of controller 100 and monitor 200 to display an image or may cause each of controller 100 and monitor 200 to display an image. It is to be noted that, in a case where an image is displayed on each of controller 100 and monitor 200, main device 300 may cause the same image to be displayed on controller 100 and monitor 200, or may cause different images to be displayed on controller 100 and monitor 200.

For example, in a case where a game is played and there are multiple users such as family members or friends, a mode of use may be assumed in which a particular user views and operates controller 100, while the other users check the progress of the game using monitor 200. In such a case, if there are multiple controllers 100 or there is a controller(s) other than controller 100, multiple users can participate in the game.

Further, by using display system 10, a user not only can play a game but also can browse web pages. Moreover, a user may browse captured images (moving images or still images) or electronic documents. In doing so, if the user wishes to view an image with another user, the user may perform an operation such that the image is displayed on each of controller 100 and monitor 200. On the other hand, if there are no other users, and the user views the image alone, it is possible to cause the image to be displayed on only one of controller 100 and monitor 200.

The following description describes an operation when a webpage is viewed, as an example of display performed by display system 10. Exemplary operation 1 is an example in which an image is displayed only on controller 100, and exemplary operation 2 is an example in which an image is displayed on each of controller 100 and monitor 200.

EXEMPLARY OPERATION 1

Figure 7:
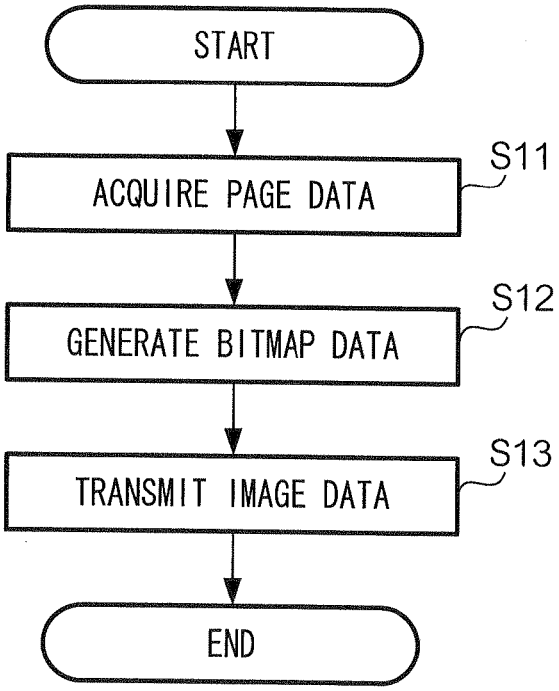
FIG. 7 shows an exemplary non-limiting flowchart showing a process executed by the main device.

FIG. 7 is a flowchart showing a basic process executed by main device 300 when causing controller 100 to display an image of a webpage. According to this process, control unit 310 of main device 300 first acquires page data in accordance with an operation performed by a user (step S11). For example, when a user presses a certain key, control unit 310 reads out a URL (Uniform Resource Locator) of a preset webpage, and acquires, via network communication unit 340, the resources (HTML (Hypertext Markup Language) data, style sheet, image data, script, etc.) indicated by the URL.

Upon receipt of the page data, control unit 310 generates bitmap data based on the page data (step S12). Control unit 310 executes a process such as rendering to generate bitmap data, and stores the bitmap data temporarily in a VRAM.

Then, control unit 310 generates image data based on the bitmap data, and transmits the image data to controller 100 via terminal communication unit 350 (step S13). Image data is data of an image and is obtained by compressing the bitmap data using a predetermined compressing technique. It is to be noted, however, that if the communication speed is sufficiently high relative to the capacity of the image data, the compressing process may be omitted. Further, the image data may include an image corresponding to an operation object, which will be described later. Upon receipt of the image data, control unit 110 of controller 100 causes the corresponding webpage image to be displayed in display region 141.

Figure 8:
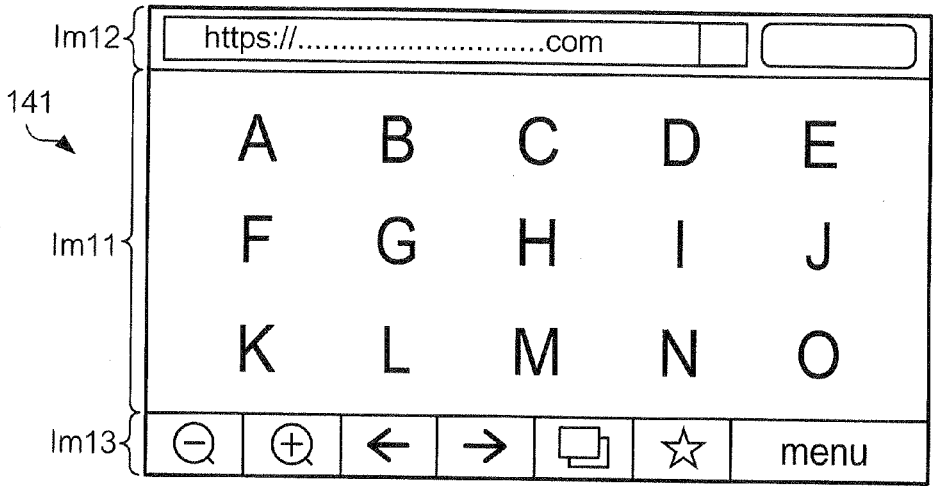
FIG. 8 shows an exemplary non-limiting diagram showing an exemplary image displayed on the controller.

FIG. 8 is a diagram showing an exemplary image displayed on controller 100. In this example, controller 100 displays menu images Im12 and Im13 in addition to webpage image Im11. Menu images Im12 and Im13 are images for displaying the URL of the displayed webpage and a textbox for enabling search using a search engine, for example. Further, menu images Im12 and Im13 each include an operation object, which is selectable by a user by performing an operation on display region 141 (touch operation). In this exemplary embodiment, the operation objects include at least reduce icon Ic1, which is an icon for reducing webpage image Im11, and magnify icon Ic2, which is an icon for magnifying image Im11, though the operation objects may include, for example, an icon for displaying a bookmark(s) (URL of one or more pre-registered favorites) or an icon for causing the displayed webpage to go back to the previously displayed page, etc. In the following description, to distinguish from a reduced image, which will be described later, an image as shown in FIG. 8 (i.e., an image before reduction) will be referred to as a "normal-size image." A normal-size image is an example of a "first image" relating to the exemplary embodiment.

A user can reduce and display a normal-size image by performing a reducing operation by pressing, for example, Y button 161Y of controller 100 displaying the normal-size image. On the other hand, by stopping pressing of Y button 161Y of controller 100 displaying the reduced image by releasing the hand from Y button 161Y, for example, the user can cause the displayed image to revert to the normal-size image. It is to be noted that, though the user performance of stopping pressing of Y button 161Y indicates "termination of a reducing operation," in the following explanation, this performance may be expressed as "performing a magnifying operation," for convenience of explanation.

Figure 9:
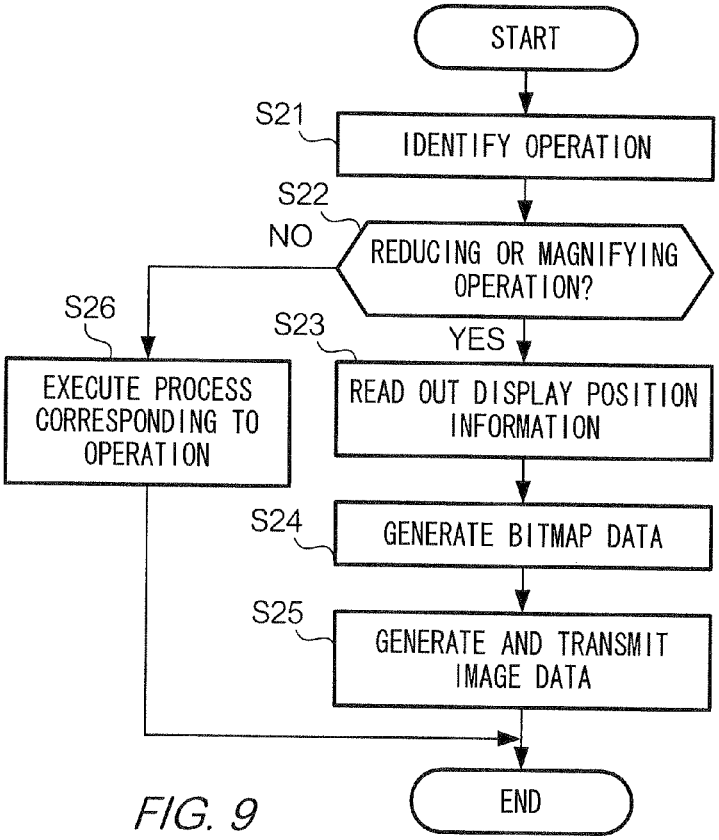
FIG. 9 shows an exemplary non-limiting flowchart showing an interruption process including a reducing process.

FIG. 9 is a flowchart showing an interruption process including a reducing process. The process shown in FIG. 9 is an interruption process executed when a user operation is performed (i.e., operation information is acquired) in a state where a normal-size image is displayed. It is to be noted that, though user operations may include operations other than a reducing operation for reducing and displaying a normal-size image, explanation here will be given mainly of the process executed when the reducing operation is performed, and explanation of the other processes may be omitted appropriately.

Upon acquisition of operation information, control unit 310 of main device 300 identifies the operation indicated by the operation information (step S21). Then, control unit 310 determines whether the identified operation is a reducing operation or a magnifying operation (step S22). If the identified operation is neither a reducing operation nor a magnifying operation, control unit 310 executes a process corresponding to the identified operation (step S26). The process in step S26 may be a process of switching the displayed normal-size image page-by-page, for example.

If the identified operation is a reducing operation or a magnifying operation (step S22; YES), control unit 310 reads out display position information from a memory such as a main memory device (step S23). Display position information indicates a position of an image to be displayed when controller 100 displays a normal-size image included in an image corresponding to entire page data. While an image is displayed on controller 100, control unit 310 stores the display position information in the memory, and updates the same as necessary.

Subsequently, control unit 310 generates bitmap data based on the page data and the display position information (step S24). For example, when a reduced image is displayed (when a reducing operation is performed in a state where a normal-size image is displayed), control unit 310 generates bitmap data based on the page data present at the position indicated by the display position information as well as the page data present located before and after the position in the webpage. At this time, the range of the page data located before and after the position indicated by the display position information is determined in accordance with a display magnification with which the reduced image is displayed. On the other hand, when a normal-size image is displayed (when a magnifying operation is performed in a state where a reduced image is displayed), control unit 310 generates bitmap data based on the page data present at the position indicated by the display position information. Then, based on this bitmap data, control unit 310 generates and transmits image data (step S25).

Figure 10:
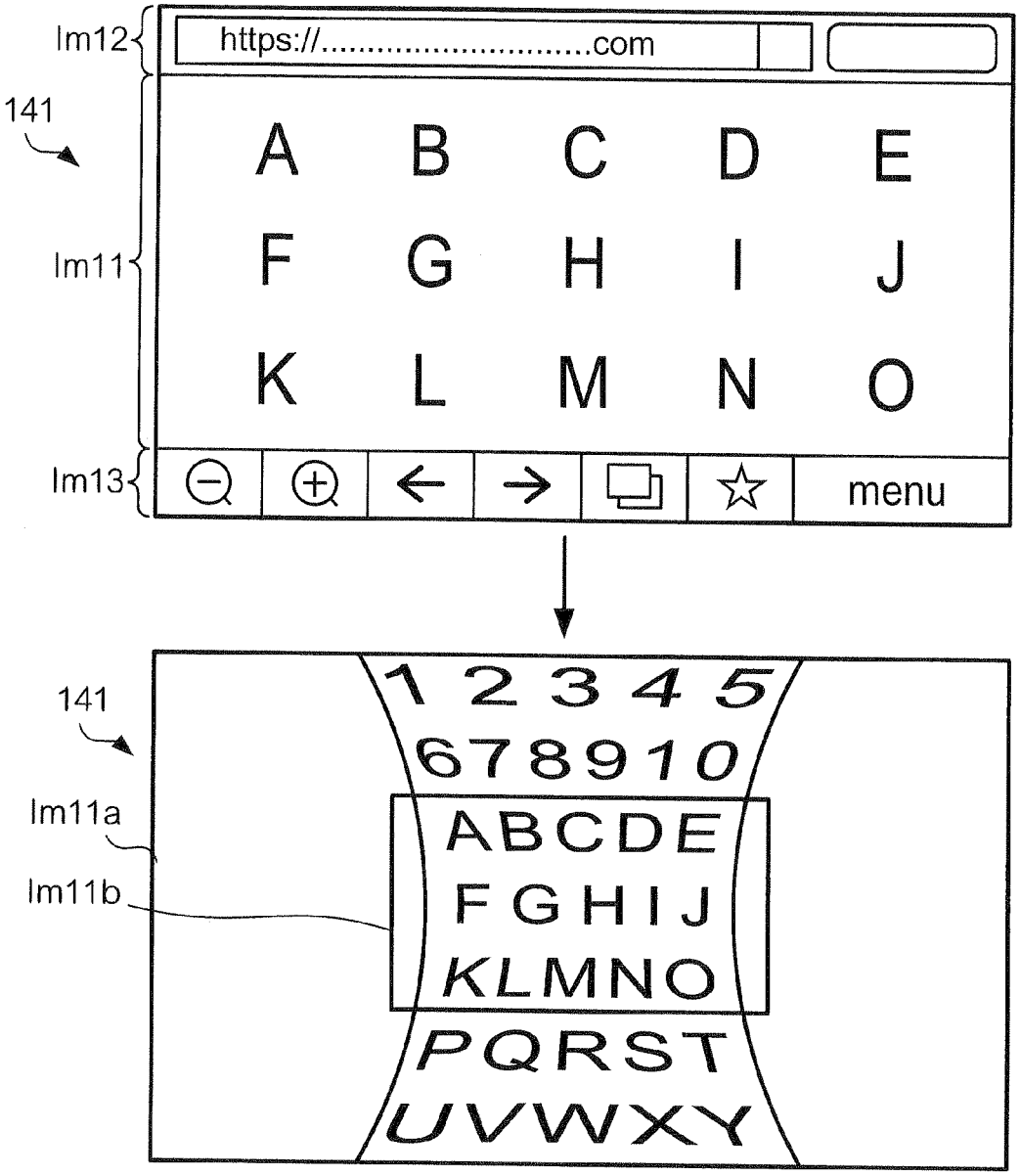
FIG. 10 shows an exemplary non-limiting diagram showing an exemplary reduced image.

FIG. 10 is a diagram showing an example in which, when a reducing operation is performed, display of an image is changed. It is assumed here that the displayed webpage is elongated in an up-down, or vertical, direction. When a reducing operation is performed in a state where image Im shown in FIG. 8 is displayed on controller 100, image Im11*a* shown in a lower part of FIG. 10 is displayed. Image Im11*a* is formed by reducing image Im11 shown in FIG. 8 and the images located before and after image Im11 in the webpage, and in the following description, image Im11*a* will be referred to as a "reduced image." The reduced image is an example of a second image relating to the exemplary embodiment.

As shown in FIG. 10, in image Im11*a*, a character closer to an end (in this example, an upper end or a lower end) of the display region has a larger size. Namely, the display magnification of an image is increased toward an end of the display region. On the other hand, an image at a central portion of image Im11*a*, having the same content as that of image Im11, is displayed to be smaller than image Im11 shown in an upper part of FIG. 10. Namely, image Im11*a* includes image Im11 displayed with a display magnification smaller than that when image Im11 is displayed alone (i.e., image Im11 whose display size is reduced). It is to be noted here that "image Im11*a* includes image Im11" means, as shown in a lower part of FIG. 10, that image Im11*a* may include, in addition to a character string "ABCDEFGHIJKLMNO", which is the content of image Im11, character strings "12345678910" and "PQRSTUVWXY," which are present located before and after the character string "ABCDEFGHIJKLMNO," respectively, in the webpage.

Figure 11:
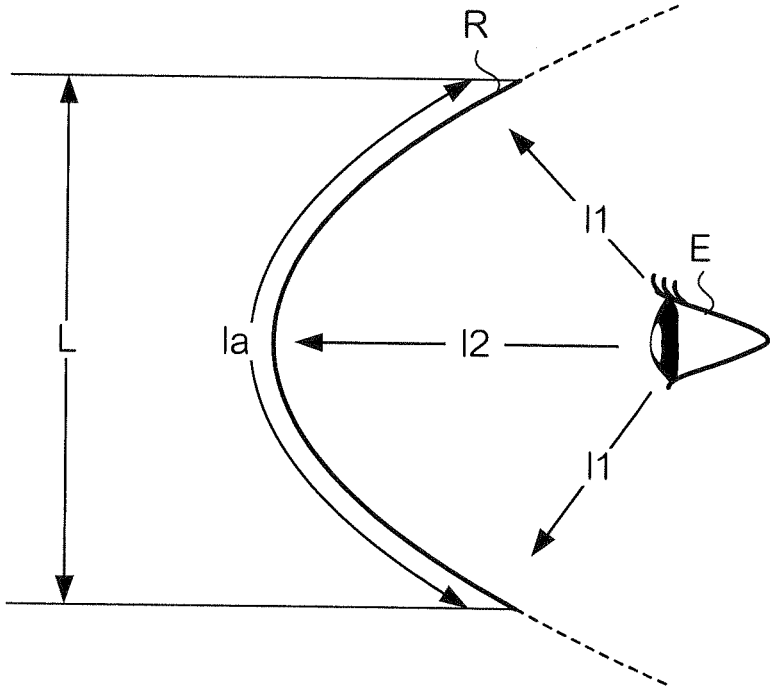
FIG. 11 shows an exemplary non-limiting diagram for explaining conceptually a state where a reduced image is displayed on a curved surface.
Figure 12:
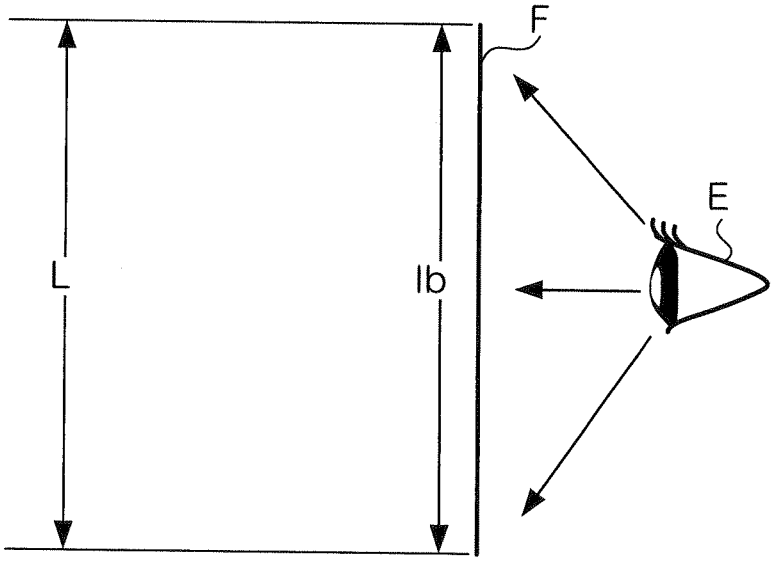
FIG. 12 shows an exemplary non-limiting diagram for explaining conceptually a state where a reduced image is displayed on a flat surface.

The display magnification is varied depending on the display position, as shown conceptually in FIG. 11, to display an image that causes a user to view an image with a sense that the image is displayed on an inner surface of a curved plane from view point E positioned on the inner surface side of the curved plane. In FIG. 11, l1 and l2 are each a distance between curved plane R and view point E, where l2>l1. Therefore, in image Im11*a*, characters in an image corresponding to the content of image Im11 (for example, in an image at a position away from view point E by distance 12) are displayed in a small size, while characters in an image corresponding to the content present located before or after image Im11 in the webpage (for example, an image at a position away from view point E by distance l1) are displayed in a large size. Thus, in a case where an image is disposed on an inner surface of a curved plane having a portion close to view point E and a portion distant from the same, an amount of information that can be presented by use of the image is increased even if the vertical length of display region 141 is a fixed value of L. Namely, in a case where an image is disposed on flat plane F as shown in FIG. 12, vertical length lb of the image in the webpage is identical with vertical length L of display region 141, while, in a case where an image is disposed on an inner surface of a curved plane as shown in FIG. 11, vertical length la of the image in the webpage is larger than vertical length L of display region 141. Reduction of an image is often performed when a user wishes to view the image in its entirety, and therefore, convenience for the user can be improved if an amount of information that can be viewed at a glance is increased, as in the present exemplary embodiment.

Further, in FIG. 10, rectangular frame image Im11*b* is an image displayed at a position indicated by the aforementioned display position information. Frame image Im11*b* indicates a portion of reduced image Im11*a* to be displayed when reduced image Im11*a* is caused to revert to normal-size image Im11. Namely, frame image Im11*b* serves as an indicator of a position of an image that is to be displayed when the displayed image reverts to a normal-size image. Thus, after a reduced image is displayed in response to a reducing operation, when an operation for magnifying the reduced image to display a normal-size image is performed (namely, when the reducing operation is terminated), the image in this frame image Im11*b* is magnified and displayed as a normal-size image. In other words, a reduced image is an image displayed temporarily after a normal-size image is displayed. By viewing frame image Im11*b* on a reduced image, a user can know what image will be displayed if the reduced image displayed on controller 100 is switched back to a normal-size image. Thus, convenience for the user can be improved. Frame image Im11*b* is an example of an "indicator image" of the exemplary embodiment. It is to be noted that, instead of frame image Im11*b*, it is possible to use, as the indicator image, an image showing the area displayed on controller 100 with one or more dots, or an image that changes the color within the area from that of another area (e.g., an image highlighting the area or an image causing the area to flicker).

Further, when a reduced image is displayed, it is possible, as shown in FIG. 10, not to display menu images Im12 and Im13 shown in FIG. 8, or to display the menu images. By not displaying the operation object(s), a user can view the reduced image without a view being hindered by the operation object(s). In the case where the operation object(s) is not displayed when a reduced image is displayed, an amount of information displayed on the screen can be increased as compared to the case where the operation object(s) is displayed, which is convenient for a user.

In this exemplary embodiment, the reduced image is displayed in place of the normal-size image only while the reducing operation is performed, i.e., only while Y button 161Y is pressed, and upon termination of the reducing operation, the normal-size image is displayed in place of the reduced image. In this way, it is possible to display the reduced image only when the user needs the reduced image, and it becomes unnecessary to display the normal-size and reduced images simultaneously. Therefore, it is possible to use the size of display region 141 efficiently to display the reduced image. Furthermore, in this exemplary embodiment, it is possible to display a reduced image without requiring multiple presses or a long press of Y button 161Y, and hence, the time required for starting display of a reduced image can be reduced, as compared to the case where these operations are required for performing reduced display.

Figure 13:
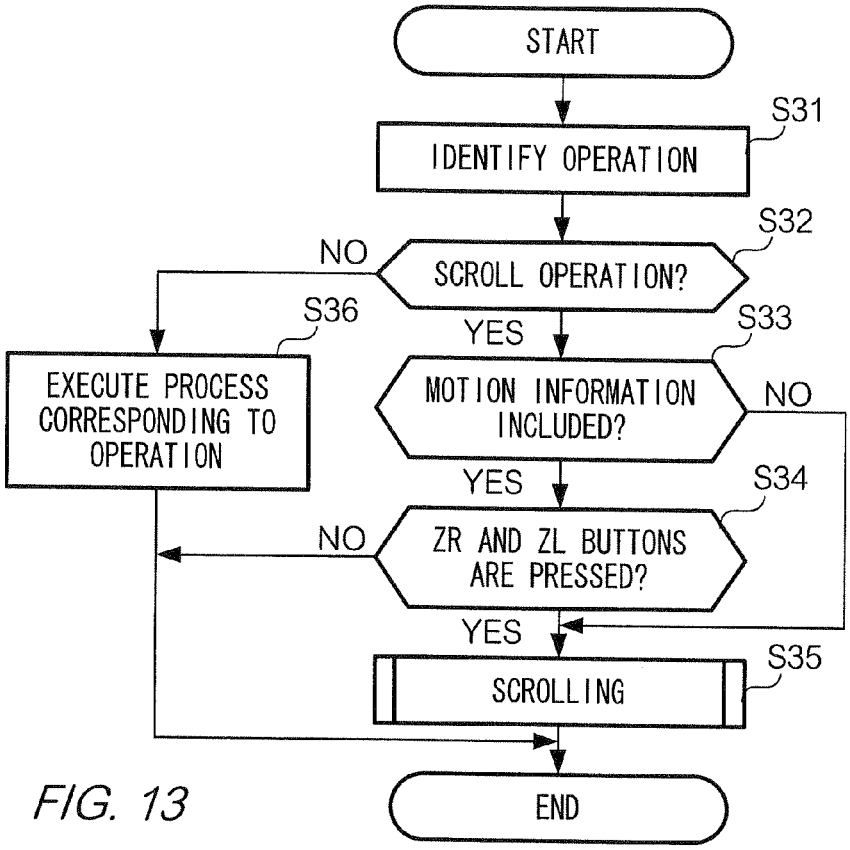
FIG. 13 shows an exemplary non-limiting flowchart showing an interruption process including a scrolling process.

Next, explanation will be given of scrolling of an image. FIG. 13 is a flowchart showing an interruption process including a scrolling process. The process shown in FIG. 13 is an interruption process executed upon acquisition of operation information when a user performs an operation in a state where a normal-size image or a reduced image is displayed. Specifically, FIG. 11 shows a process when an operation for scrolling an image (hereinafter, "scroll operation") is performed as the user operation. The process shown in FIG. 13 may be incorporated into the process shown in FIG. 9, such that they are executed simultaneously in parallel.

In this exemplary embodiment, the scroll operation can be achieved by the following three ways of operation; the first operation is a touch operation on display region 141, the second operation is an operation using slide pad 162, and the third operation is an operation of moving controller 100. The third operation is processed, for example, in such a manner that, when a user tilts controller 100 with the part of the casing of controller 100 facing away from the user being lowered and the part of the casing facing toward the user being raised, the image displayed in display region 141 is caused to move toward the user so that a near-side image that has been hidden comes into view. Conversely, when a user tilts controller 100 with the part of the casing of controller 100 facing toward the user being lowered and the part of the casing facing away from the user being raised, the image displayed in display region 141 is caused to move away from the user so that a far-side image that has been hidden comes into view. It is to be noted that, in the third operation, instead of being performed based on an attitude of controller 100, scrolling of an image may be performed based on movement of controller 100 that does not cause a change in its attitude. Further, it is possible to vary the speed or amount of scrolling of an image in accordance with motion information of controller 100. For example, if controller 100 is tilted quickly, an image may be scrolled fast or an amount of scrolling of an image may be increased.

It is also to be noted that the scroll operation does not have to be achieved by three ways of operation, and may be achieved by only one or two ways. Further, if there are multiple ways of scroll operation, it is preferred that an order of priority of operations should be predetermined to avoid conflict between operations. In the present exemplary embodiment, the operation information of a touch operation on display region 141 is given top priority (i.e., the highest priority), and the motion information is given the lowest priority. In this case, when control unit 310 acquires the operation information of a touch operation and the motion information, control unit 310 processes the former with priority. For example, if the operation information of a touch operation indicates downward scrolling while the motion information indicates upward scrolling, control unit 310 determines that downward scrolling should be performed.

Upon acquisition of operation information, control unit 310 of main device 300 identifies the operation indicated by the operation information (step S31). This step is performed in a manner similar to that in step S21 shown in FIG. 9. Subsequently, control unit 310 determines whether the identified operation is a scroll operation (step S32). In doing so, control unit 310 determines whether one of the aforementioned first to third operations is performed.

If it is determined that an operation other than the scroll operation is performed, control unit 310 executes a process corresponding to this operation (step S36). The process executed in step S36 may include the process executed when the reducing operation is performed (see FIG. 9), for example, or may include another process. Since these processes are not directly relevant to scrolling of the screen, explanation thereof is omitted here.

If the identified operation is a scroll operation, control unit 310 determines the type of scroll operation. Specifically, control unit 310 determines whether the acquired operation information includes the motion information generated by motion detection unit 170 (step S33). If the operation information includes the motion information, control unit 310 determines further whether the operation information includes operation information indicating that ZL button 161ZL and ZR button 161ZR are pressed (step S34).

It is to be noted that, instead of the process of step S34, or in addition to the process of step S34, control unit 310 may determine whether the amount of motion (amount of movement, extent of inclination) indicated by the acquired motion information is equal to or greater than a predetermined amount, and may proceed to the process of step S35 if the amount of motion is equal to or greater than the predetermined amount. Namely, an operation of pressing ZL button 161ZL and ZR button 161ZR may be dispensable.

Control unit 310 executes a scroll process in the case where the operation information does not include motion information or in the case where the operation information includes motion information and ZL button 161ZL and ZR button 161ZR are pressed (step S35). On the other hand, in the case where the operation information includes motion information but ZL button 161ZL or ZR button 161ZR is not pressed, control unit 310 does not perform the scroll process, and disregards the motion information. Namely, in this exemplary embodiment, the scroll operation indicated by the motion information is made effective by pressing of ZL button 161ZL and ZR button 161ZR, and is ineffective if these buttons are not pressed.

Figure 14:
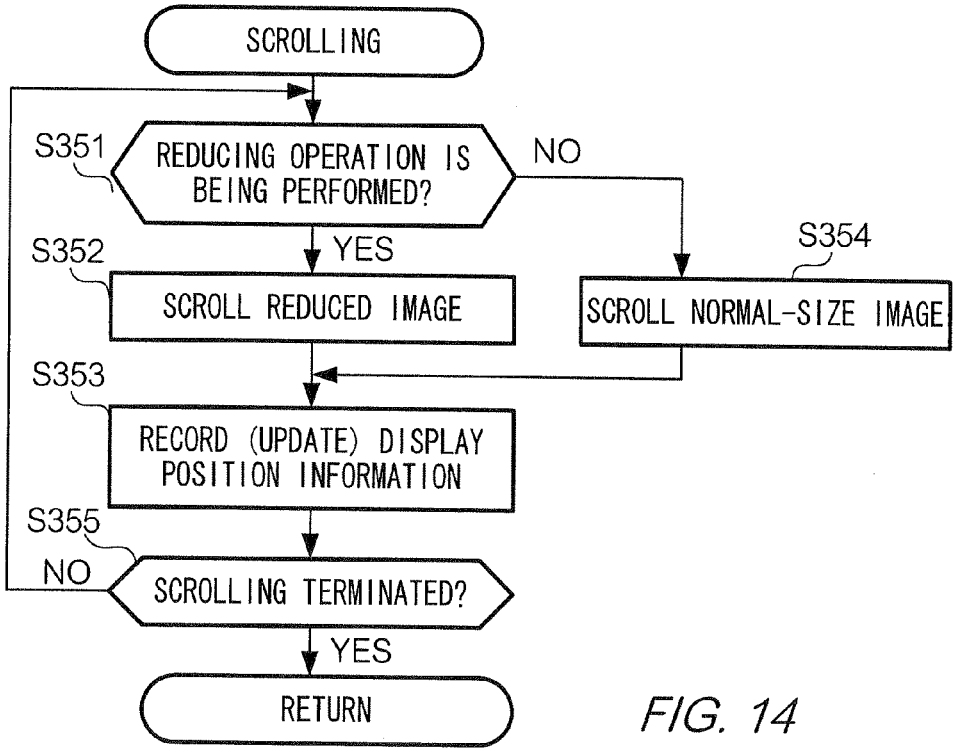
FIG. 14 shows an exemplary non-limiting flowchart showing a scroll process included in the scrolling process.

FIG. 14 is a flowchart showing the scroll process in step S35 in detail. In this scroll process, control unit 310 first determines whether a reducing operation is being performed by the user (step S351), and executes different processes depending on the result of this determination. Control unit 310 makes this determination by determining whether Y button 161Y is pressed.

If it is determined that a reducing operation is being performed, control unit 310 causes the currently displayed reduced image to be scrolled in accordance with the scroll operation performed by the user (step S352). Then, control unit 310 updates the recorded display position information in accordance with movement of the reduced image resulting from the scrolling (step S353). Namely, control unit 310 records, as the display position information, the position of a part of the displayed reduced image at which aforementioned frame image Im11*b* is positioned (the position in the webpage). During scrolling of a reduced image, the position of frame image Im11*b* in display region 141 is always a fixed position (for example, at a central portion of display image 141, as shown in the lower part of FIG. 10), but relative to the whole of the webpage, the position of frame image Im11*b* is caused to change as a result of scrolling.

On the other hand, if it is determined that a reducing operation is not being performed, control unit 310 causes the currently displayed normal-size image to be scrolled in accordance with the scroll operation performed by the user (step S354). Control unit 310 records, as the display position information, the position of the displayed normal-size image (the position in the webpage) in accordance with movement of the normal-size image caused by scrolling (step S353).

After causing the normal-size image or the reduced image to scroll as described in the foregoing, control unit 310 determines whether the scroll operation is terminated (step S355), and repeats the process from step S351 to S354 until the scroll operation is terminated.

Figures 15A, 15B, 15C, 15D:
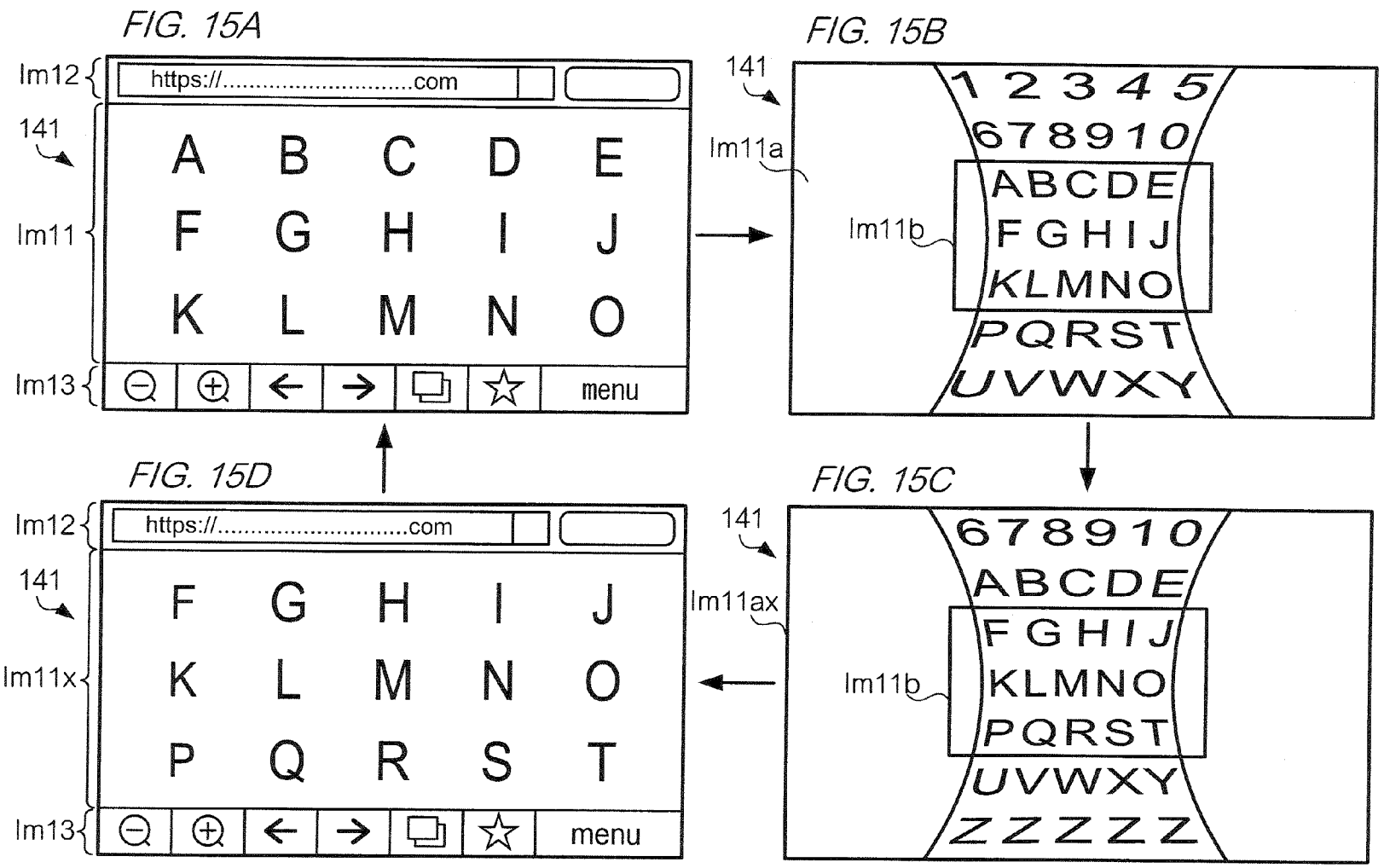
FIGS. 15A through 15D show an exemplary non-limiting diagram showing exemplary transitions between images displayed on the controller.

FIG. 15A through 15D are diagrams showing exemplary transitions between images displayed on controller 100. As shown in FIG. 15A, if a reducing operation is performed in a state where image Im11, which is a normal-size image, is displayed, image Im11*a*, which is a reduced image, is displayed as shown in FIG. 15B.

Further, if a scrolling operation is performed in a state where image Im11*a* is displayed, image Im11*ax*, which is an image resulting from scrolling of image Im11*a* downward by one line, for example, is displayed as shown in FIG. 15C. At this time, a character string representing the image in frame image Im11*b* changes from "ABCDEFGHIJKLMNO" to "FGHIJKLMNOPQRST." Namely, the position of frame image Im11*b* in the webpage (that is, the position indicated by the display position information) changes as shown in FIG. 15D. On the other hand, the position of frame image Im11*b* in display region 141 does not change.

Then, if a magnifying operation is performed (namely, when the reducing operation is terminated) in a state where image Im11*ax* is displayed, image Im11*x*, which is a normal-size image, is displayed. Image Im11*x* has the same content as that of the image in frame image Im11*b*, and therefore, in this example, is an image of the character string "FGHIJKLMNOPQRST." Thus, in a case where display of a reducing image is changed to display of a normal-size image after the position of the frame image relative to the reduced image is changed as a result of scrolling of the reduced image, the image present at the position indicated by the frame image in the reduced image is displayed as a normal-size image. The frame image displayed in the reduced image is not displayed in the normal-size image.

Further, if, in a state where image Im11*x* is displayed, a scroll operation for scrolling the image by one line is performed, the displayed image reverts to image Im11, as shown in FIG. 15A.

Since the scroll operation in this exemplary embodiment is performed as an operation independent of the reducing operation, it is possible, for example, to start the reducing operation while the scroll operation is performed, or to start the scroll operation while the reducing operation is performed. Thus, the user can perform one of the two operations as necessary, irrespective of whether the other is being performed.

Further, the scroll operation of this exemplary embodiment requires pressing of ZL button 161ZL and ZR button 161ZR for the motion information generated by the motion detection unit 170 to be effective as the operation information indicating the scroll operation. Namely, ZL button 161ZL and ZR button 161ZR function as switches that can be pressed in this case, and only when the switches are on (pressed), scrolling of an image is carried out. As is described in the foregoing, when ZL button 161ZL and ZR button 161ZR are pressed using both hands, the user can hold controller 100 firmly, and thus, more precise motion information is acquired.

For example, if the user is allowed to operate controller 100 by a single hand, controller 100 tends to make an unintended motion (motion different from that intended for the scroll operation), and it becomes difficult to distinguish between the unintended motion and the motion for the scroll operation, which increases a possibility that unintended scrolling of an image is performed by the user. In contrast, if a rule is applied that requires the user to press ZL button 161ZL and ZR button 161ZR when the scroll operation is performed, the user is prompted to hold controller 100 in a preferred way (see FIG. 3), and therefore, it can be expected that the possibility of erroneous detection of scroll operation by main device 300 will be reduced, as compared to the case where such a rule is not applied. It is to be noted that such an effect can also be achieved by requiring pressing of L button 161 L and R button 161 R instead of requiring pressing of ZL button 161ZL and ZR button 161ZR.

EXEMPLARY OPERATION 2

Unlike aforementioned Exemplary Operation 1, an image is displayed on each of controller 100 and monitor 200 in this exemplary operation. However, the operation of controller 100 is basically the same as in Exemplary Operation 1. Therefore, in this exemplary operation, explanation of the operation of controller 100 will be omitted as appropriate.

Figure 16A:
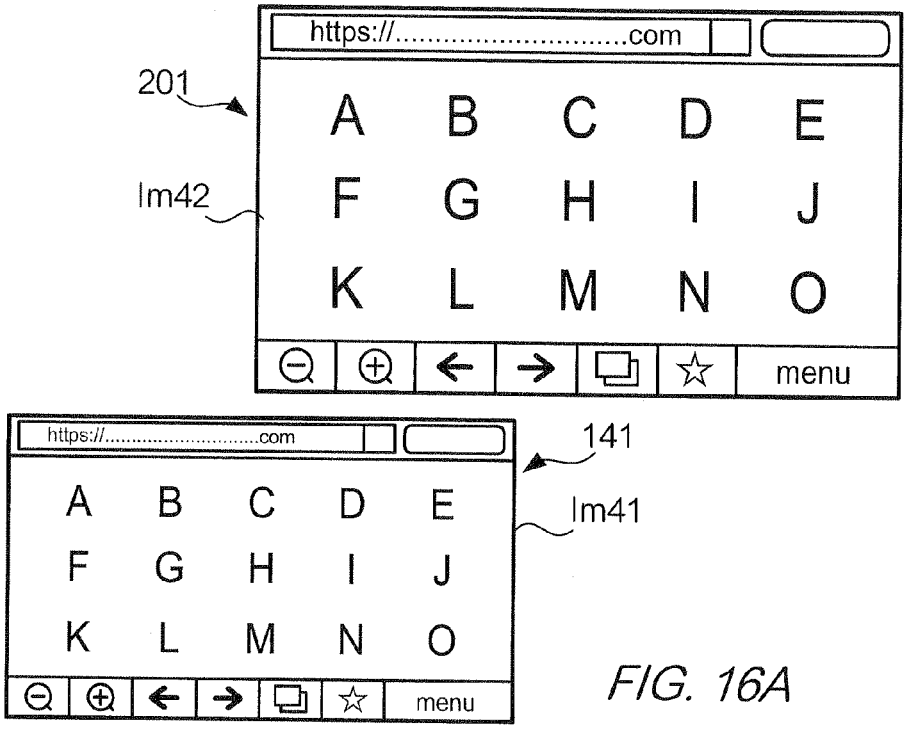
FIGS. 16A and 16B show exemplary non-limiting diagrams showing exemplary images displayed on a controller and on a monitor.
Figure 16B:
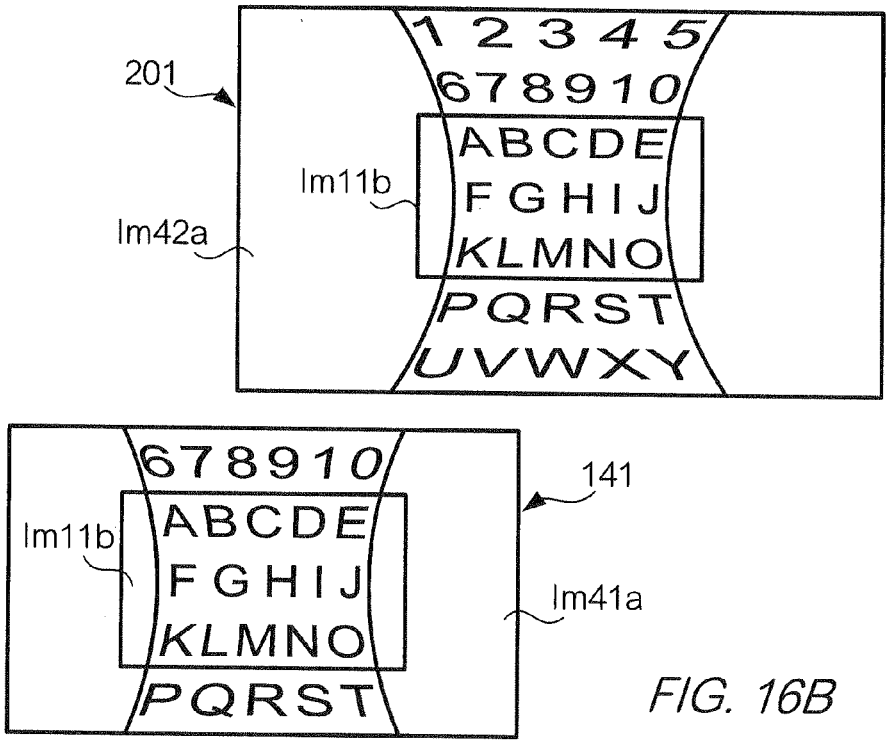

FIGS. 16A and 16B are diagrams showing exemplary images displayed in display region 141 of controller 100 and display region 201 of monitor 200. In this example, controller 100 and monitor 200 each display an image of the same webpage. FIG. 16A shows the state where image Im41 and image Im42 (each being a normal-size image) are displayed in display region 141 of controller 100 and display region 201 of monitor 200, respectively. FIG. 16B shows the state where image Im41*a* and image Im42*a* (each being a reduced image), which are obtained by reducing image Im41 and image Im42, respectively, are displayed in display region 141 of controller 100 and display region 201 of monitor 200, respectively.

Like image Im41 shown in FIG. 16A, the normal-size image displayed on controller 100 may be the same image as image Im42 displayed in display region 201 of monitor 200, or may be an image different from image Im42. For example, the normal-size image displayed on controller 100 may be a part of image Im42 displayed in display region 201 of monitor 200. Namely, the normal-size image displayed in display region 141 of controller 100 does not have to have the same magnification (or the same size) as that of the image displayed in display region 201 of monitor 200. The term "normal-size" of the normal-size image means that the image is not reduced compared to a reduced image, and does not refer to comparison with the image displayed on monitor 200. It is to be noted that the magnification of the displayed image is represented relative to the normal-size image displayed on controller 100, though it is also possible to represent the magnification relative to the image displayed on monitor 200.

If a reducing operation is performed in a state where images Im41 and Im42, which are normal-size images, are displayed on controller 100 and monitor 200, respectively, image Im41*a*, which is a reduced image, is displayed in display region 141 of controller 100, and image Im42*a*, which also is a reduced image, is displayed in display region 201 of monitor 200. At this time, reduced image Im41*a* displayed on controller 100 is a partial image of image Im42*a* displayed in display region 201 of monitor 200. Namely, monitor 200 has a larger webpage display area than that of controller 100. By viewing display region 201 of monitor 200, a user can view a part of an image that cannot be displayed in display region 141 of controller 100.

Modifications

The exemplary embodiment described in the foregoing can be carried out in other embodiments, as shown by the following modifications. It is to be noted that multiple modifications may be combined as required in carrying out the exemplary embodiment.

Modification 1

Figure 17:
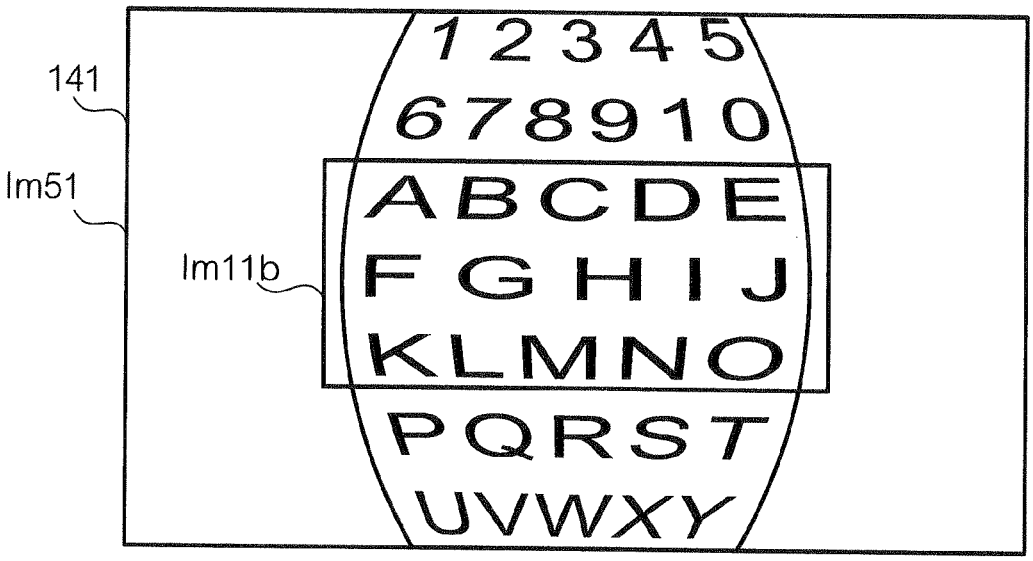
FIG. 17 shows an exemplary non-limiting diagram showing an exemplary reduced image.
Figure 18:
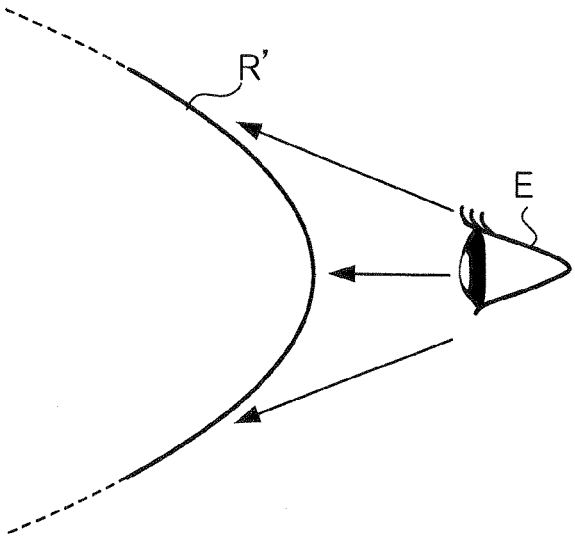
FIG. 18 shows an exemplary non-limiting diagram for explaining conceptually a state where a reduced image is displayed on a curved surface.

In the exemplary embodiment, control unit 310 of main device 300 causes a reduced image to be displayed in the display region of controller 100 or monitor 200 such that the display magnification is increased toward an end of the display region. However, it is possible to cause a reduced image to be displayed such that the display magnification is decreased toward an end of the display region, in a manner opposite to that in the exemplary embodiment. FIG. 17 is a diagram showing an example of an image displayed in display region 141 of controller 100, and image Im51 is an example of the reduced image. As shown conceptually in FIG. 18, this image simulates an image displayed on an outer surface of a curved plane R', which is curved in a direction opposite to that shown in FIG. 11, and viewed from view point E positioned on the outer surface side of the curved plane. In this case, image Im51, which is a reduced image, includes a reduced normal-size image. Further, in this case, an amount of information that the user can view at a glance is increased, as compared to a case where an image is disposed on flat plane F as in FIG. 12, and thus, convenience for the user can be improved. It is to be noted that the display magnification does not have to be decreased or increased toward the upper and lower ends of the display region over an entirety of the reduced image, and it is possible that the display magnification is decreased or increased toward the upper and lower ends of the display region in at least a part of the reduced image, because if a part of the reduced image is displayed in such a manner, an amount of information that can be viewed by the user is increased.

Further, in the exemplary embodiment and in the foregoing modified example, the display magnification is decreased or increased toward the upper and lower ends of the display region of controller 100 or monitor 200. However, the "end" herein may be any position in the display region. For example, in a case where scrolling is performed in left and right directions, the display magnification may be decreased or increased toward the left and right ends of the display region. Namely, it is desired that the display magnification is decreased or increased toward an end of the display region in a direction parallel to the scrolling direction.

Modification 2

Figure 19:
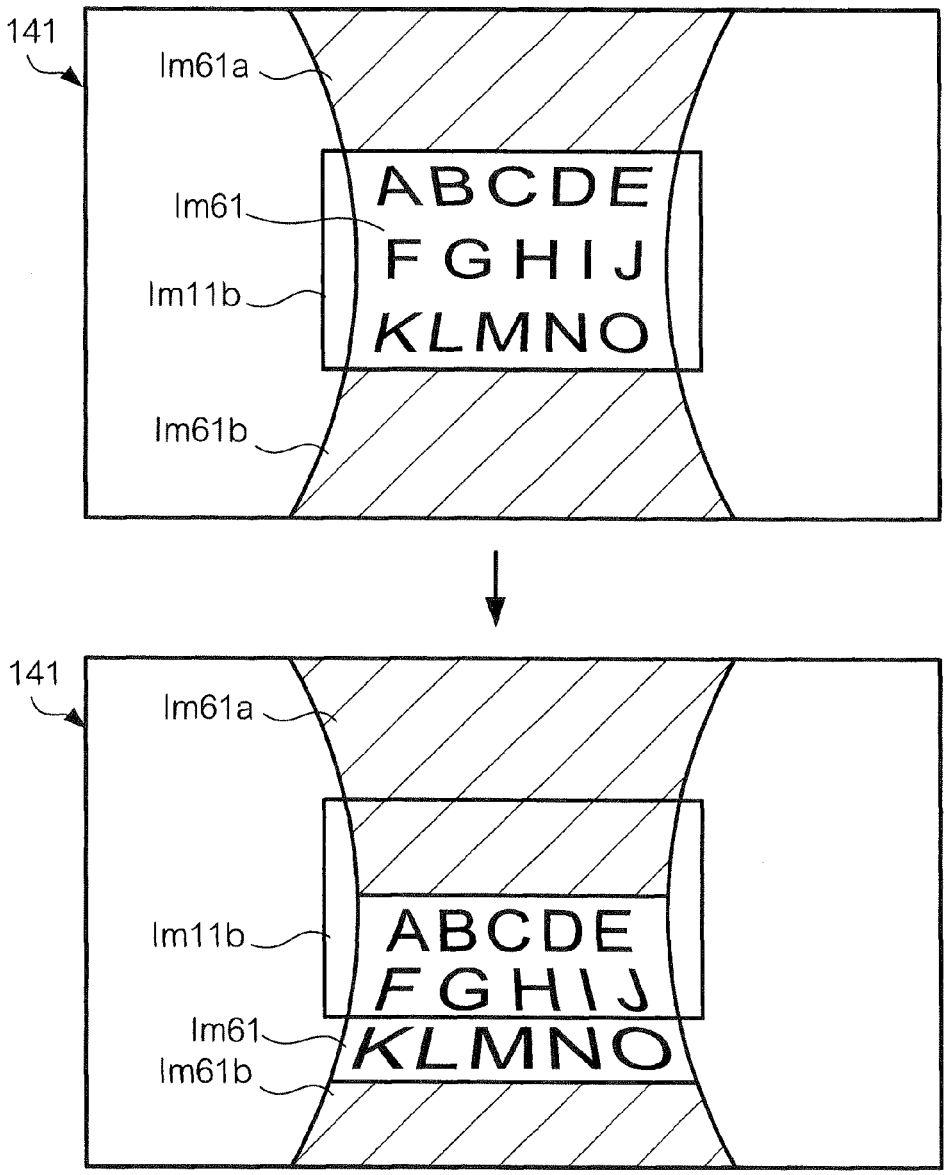
FIG. 19 shows an exemplary non-limiting diagram showing exemplary reduced images.

Some normal-size images may be of a size with no margin for scrolling. Namely, in such a case, when a normal-size image is displayed, the whole of the content representing the normal-size image can be viewed at a glance. When displaying a reduced image based on such a normal-size image, control unit 310 of main device 300 generates continuation images Im61*a* and Im61*b* adjoining, in the direction of scrolling, image Im61, which is obtained by reducing the normal-size image, and causes a reduced image including image Im61 and continuation images Im61*a*, Im61*b* to be displayed, as shown in an upper part of FIG. 19. Each of these images Im61*a* and Im61*b* may be an image of a predetermined pattern or a predetermined color, for example. When such a reduced image is scrolled, control unit 310 of main device 300 causes images Im61, Im61*a*, and Im61*b* to scroll in their entirety. In this way, even if an image has no margin for scrolling, it is possible to scroll the image.

Modification 3

In the exemplary embodiment, a normal-size image and a reduced image are displayed alternatively. However, the display magnification of the reduced image may be selected from multiple values. For example, control unit 310 may perform reduction in steps (or magnify a reduced image in steps) according to a number of times a predetermined operation such as pressing of reduce icon Ic1 or magnify icon Ic2 is performed. In this way, it is possible to enable setting of the magnification more precisely than in the exemplary embodiment.

Modification 4

In the foregoing exemplary embodiment, the reducing operation is achieved by continuous pressing of Y button 161Y. However, the reducing operation is not limited to this operation. For example, controller 100 may display a reduced image upon release of Y button 161Y when Y button 161Y is pressed once, and thereafter, may switch the displayed image from the reduced image to the normal-size image when Y button 161Y is pressed again. Further, controller 100 may be able to perform these two methods of operation.

Figure 20:
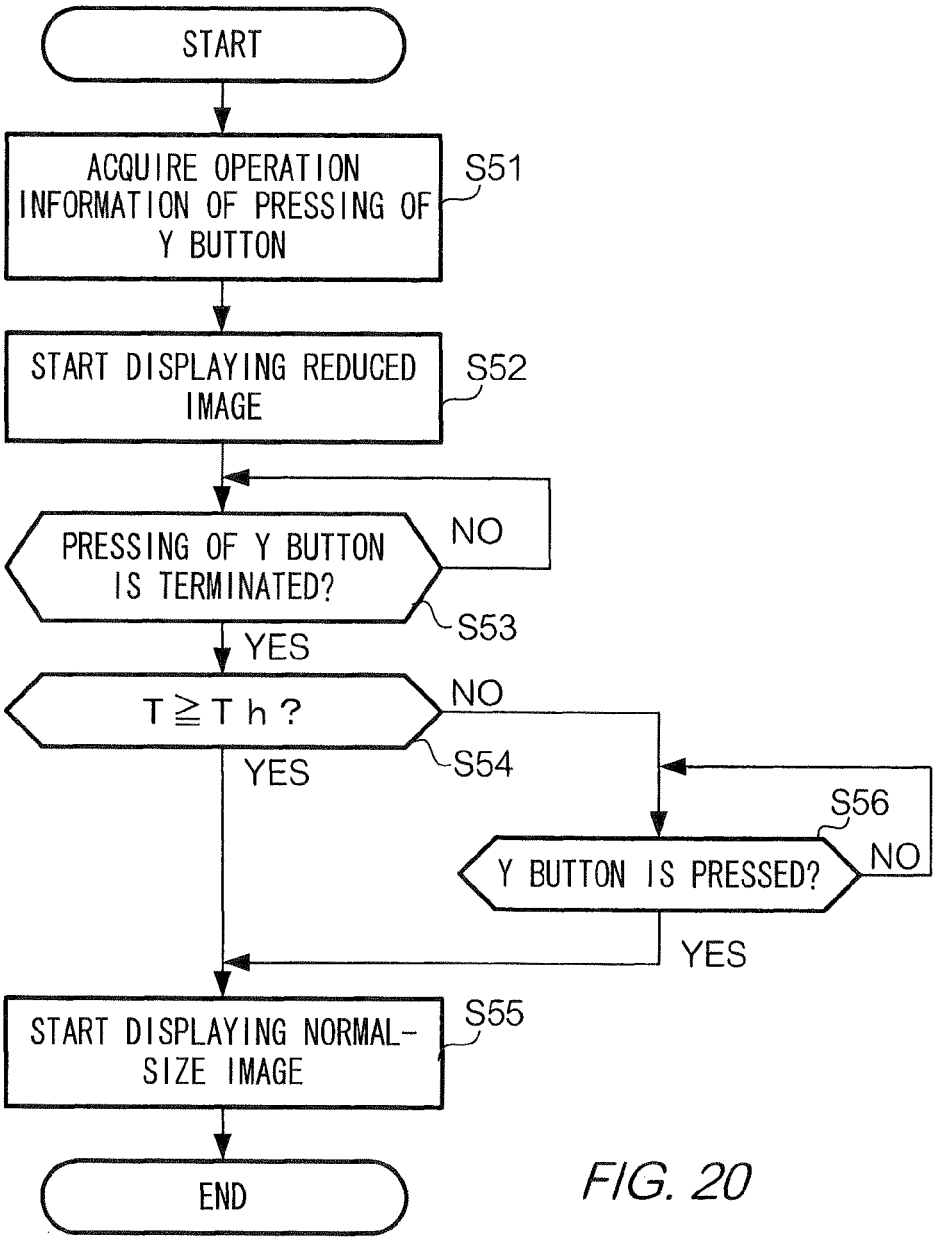
FIG. 20 shows an exemplary non-limiting flowchart showing a process executed by the main device.

FIG. 20 is a flowchart showing a process for achieving the aforementioned two ways of operation. In this process, upon acquisition of operation information indicating that Y button 161Y is pressed (step S51), control unit 310 of main device 300 starts display of a reduced image (step S52). It is assumed that Y button 161Y is continuously pressed at this moment. After displaying the reduced image, control unit 310 determines whether Y button 161Y is released, based on the operation information (step S53). Control unit 310 repeats this determination until Y button 161Y is released. Upon release of Y button 161Y, control unit 310 compares the duration time (T) of the pressing operation of Y button 161Y (i.e., reducing operation) with a predetermined threshold value (Th) to determine whether the duration time of the reducing operation (namely, the time period for which Y button 161Y was being pressed) is equal to or longer than a predetermined time period (step S54). It is to be noted that this threshold value may be a predetermined value, or may be a value that can be set by a user.

In the case where the duration time of the reducing operation is equal to or longer than the predetermined time period, control unit 310 switches the displayed image from the reduced image to the normal-size image in response to release of Y button 161Y (step S55). Control unit 310 achieves this by switching the image transmitted to controller 100. This method of operation corresponds to the method of operation described in the foregoing exemplary embodiment. On the other hand, in the case where the duration time of the reducing operation is shorter than the predetermined time period, control unit 310 causes the reduced image to be displayed continuously without causing the normal-size image to be displayed, even if Y button 161Y is released. In this case, control unit 310 determines whether Y button 161Y is pressed again to wait for the next reducing operation to be performed (step S56). Then, if the next reducing operation is performed, control unit 310 switches the displayed image from the reduced image to the normal-size image (step S55).

This provides the user with choices for performing the reducing operation. Thus, when the user wishes to have the reduced image displayed for an extended period of time, for example, the user does not have to press Y button 161Y continuously. Further, the user can select whichever operation s/he feels comfortable with in accordance with her/his preference.

Modification 5

The exemplary embodiment does not have to be carried out in a main device 300, in a display system including main device 300 and controller 100, or in a display system (display system 10) further including monitor 200, but also can be carried out in an information-processing device including integrally a configuration corresponding to main device 300 and a configuration corresponding to controller 100. Further, the display device of the exemplary embodiment does not have to be of a shape to be held with both hands, but may be of such a shape that it is to be held by a single hand, or may be adapted to be placed on a desk or the like when operated. The information-processing device of the exemplary embodiment does not have to have a game function.

Further, the exemplary embodiment may be carried out not only as an information-processing device or a display system as described in the foregoing, but also as a displaying method for causing a display device to display an image or a program for executing such a displaying method. Furthermore, the program of the exemplary embodiment may be stored in a storage medium such as an optical disk or a semiconductor memory, or may be downloaded to an information-processing device via a network such as the Internet.

The foregoing description of the embodiments of the exemplary embodiment is provided for purposes of illustration and description, and is in no way to be taken as either exhaustive or specifically limitative of the exemplary embodiment; and it will be obvious to those skilled in the art that a wide range of modifications and variations can be applied to the exemplified embodiments, with such embodiments having been chosen merely with a view to providing a clear explanation of the principles of the exemplary embodiment and its range of practical application, thereby to enable others skilled in the art to understand the exemplary embodiment in the context of a variety of embodiments, which can be adopted in the scope of the exemplary embodiment so as to best suit a contemplated use. The scope of the exemplary embodiment is intended to be defined by the claims that follow and equivalents thereof.

What is claimed is:

1. An information-processing device comprising:

a first display controller configured to display selectively on a display a first image in an original display size and a second image including the first image in a reduced size; and a second display controller configured, while the second image is displayed on the display device, to display an indicator image on the display device, the indicator image indicating a position of an image to be displayed when display of the second image is changed to display of the first image in its original display size.

2. The information-processing device according to claim 1, wherein the first display controller is further configured to display the second image temporarily after the first image is displayed.

3. The information-processing device according to claim 1, further comprising a scroll controller configured, while the second image is displayed on the display device, to cause the second image to scroll in response to a scroll operation performed by a user.

4. The information-processing device according to claim 3, wherein the second display controller is further configured to change a position of the indicator image relative to the second image in response to scrolling of the second image performed by the scroll controller.

5. The information-processing device according to claim 4, wherein the first display controller is further configured, when display of the second image is changed to display of the first image after the position of the indicator image relative to the second image is changed in response to scrolling of the second image performed by the scroll controller, to cause an image present at the position indicated by the indicator image in the second image to be displayed as the first image.

6. The information-processing device according to claim 4, wherein the second display controller is further configured, when the position of the indicator image relative to the second image is changed in response to scrolling of the second image performed by the scroll controller, not to change the position of the indicator image relative to a display region of the display device.

7. The information-processing device according to claim 3, further comprising an acquisition unit configured to acquire motion information representing motion of the display device, wherein the scroll controller causes the second image to scroll based on the motion information acquired by the acquisition unit.

8. The information-processing device according to claim 7, wherein the scroll controller is further configured to cause the second image to scroll such that the speed of scrolling of the second image is changed based on the motion information acquired by the acquisition unit.

9. The information-processing device according to claim 7, further comprising a detection unit configured to detect that a user is holding the display device, wherein the scroll controller is further configured, while holding of the display device by the user is detected by the detection unit, to cause the second image displayed on the display device to scroll based on the motion information acquired by the acquisition unit.

10. The information-processing device according to claim 7, wherein the display device is provided with a hardware key or a software key, and the scroll controller is further configured to cause the second image displayed on the display device to scroll based on an operation performed using the key and the motion information acquired by the acquisition unit, such that, when an operation is performed using the key, the operation using the key is treated with a higher priority than the motion information.

11. The information-processing device according to claim 3, wherein the first display controller is further configured to generate a continuation image adjoining the first image in a direction of scrolling, and to display the second image including the first image and the continuation image.

12. The information-processing device according to claim 1, wherein the second display controller is further configured, when display of the second image is changed to display of the first image, to cause the indicator image displayed in the second image not to be displayed in the first image.

13. The information-processing device according to claim 1, wherein the first display controller is further configured to cause an operation object for performing an operation relating to the first image to be displayed when the first image is displayed, and to cause the operation object not to be displayed when the second image is displayed.

14. A computer-readable non-transitory storage medium storing a program for causing a computer to execute:

displaying selectively on a display device a first image in an original display size and a second image including the first image in a reduced size; and while the second image is displayed on the display device, displaying an indicator image on the display device, the indicator image indicating a position of an image to be displayed when display of the second image is changed to display of the first image in its original display size.

15. An image-displaying method comprising:

selectively displaying on a display device a first image in an original display size and a second image including the first image in a reduced size; and while the second display is displayed on the display, displaying an indicator image on the display, the indicator image indicating a position of an image to be displayed when display of the second image is changed to display of the first image in its original display size.

16. A display system comprising:

a display;

a first display controller configured to display selectively on the display a first image in an original display size and a second image including the first image in a reduced size; and a second display controller configured, while the second display is displayed on the display, to display an indicator image on the display, the indicator image indicating a position of an image to be displayed when display of the second image is changed to display of the first image in its original display size.

* * * * *